United States Patent [19]

Thomas

[11] 4,312,200

[45] Jan. 26, 1982

[54] KEY CONSTRUCTION

[76] Inventor: Richard D. Thomas, 5816 W. 55th St., Chicago, Ill. 60638

[21] Appl. No.: 112,950

[22] Filed: Jan. 17, 1980

[51] Int. Cl.[3] ..... E05B 19/04

[52] U.S. Cl. ..... 70/408; 70/456 R

[58] Field of Search ..... 70/456 R, 456 B, 457–459, 70/408, 401, 399, 395

[56] References Cited

U.S. PATENT DOCUMENTS

| | | | |
|---|---|---|---|
| 2,105,763 | 1/1938 | De Berry | 70/456 R |
| 3,292,400 | 12/1966 | Merila | 70/456 R |
| 3,420,078 | 1/1969 | Nielsen | 70/456 R |

*Primary Examiner*—Robert L. Wolfe

*Attorney, Agent, or Firm*—Wallenstein, Wagner, Hattis, Strampel & Aubel

[57] ABSTRACT

A key construction comprising a pair of key shanks joined at one end to provide a unitary body portion having aligned, oppositely extending key bits each of which is adapted for use in a different lock tumbler. In one of its forms, the key shanks are secured in end-to-end relation by means of a sleeve. The sleeve desirably is provided with a pin to which an end of a key bit receiving and holding member is attached. The key bit receiving and holding member advantageously is constructed in a manner to enable only one of the key bits to be pivoted from a normally, inoperable position in the receiving and holding member to an operable, lock tumbler engaging position. Thus, one key bit can be easily and readily distinguished from the other key bit, and there can be no mistake as to which key bit is to be engaged in which lock tumbler. In another of its forms, one of the key bits is provided with a groove or depression which desirably is engaged by a ridge or rib formed on the inner wall of a key bit receiving and holding member which is separable from the joined key shanks. This arrangement likewise enables one key bit to be easily and readily distinguished from the other key bit.

5 Claims, 12 Drawing Figures

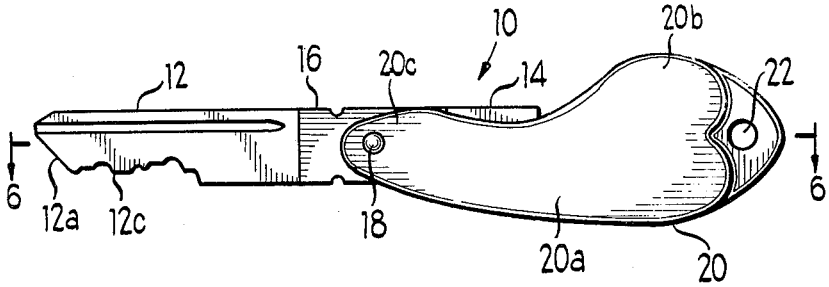
Fig 1
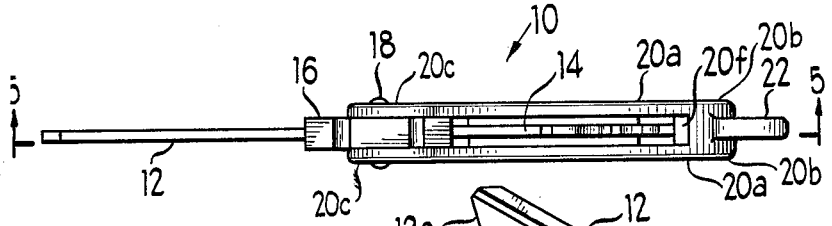
Fig 2
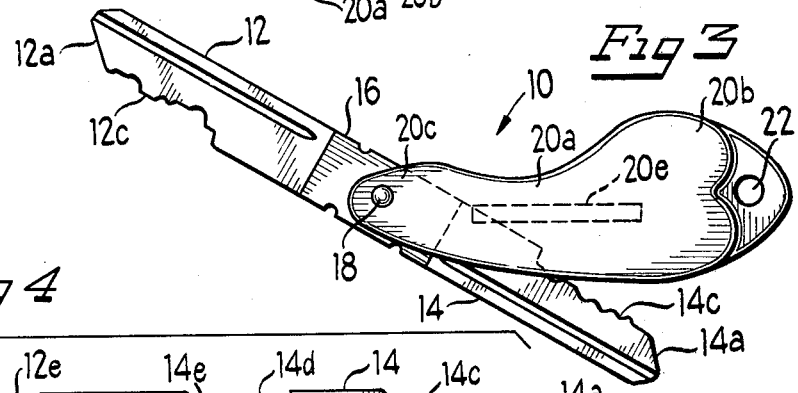
Fig 3
Fig 4
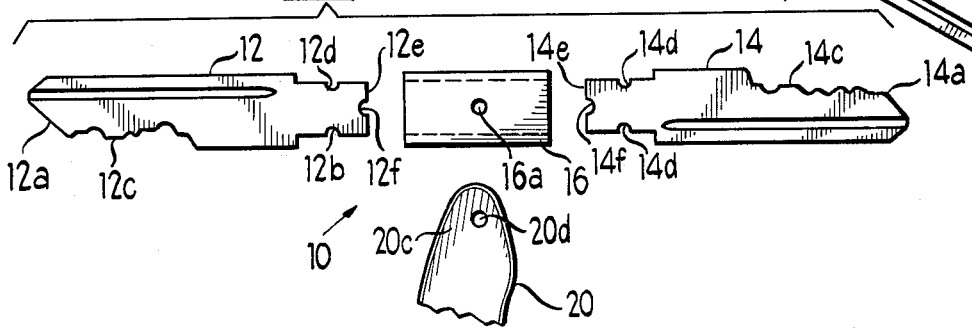
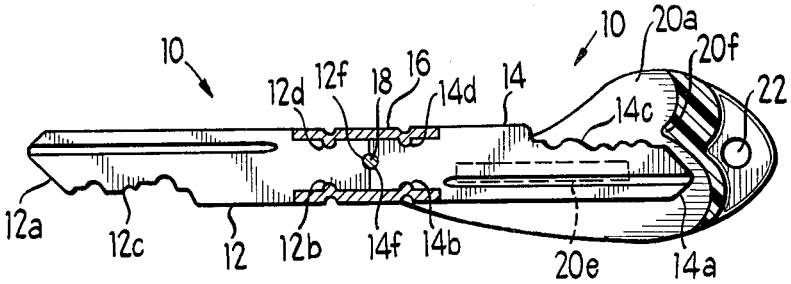
Fig 5
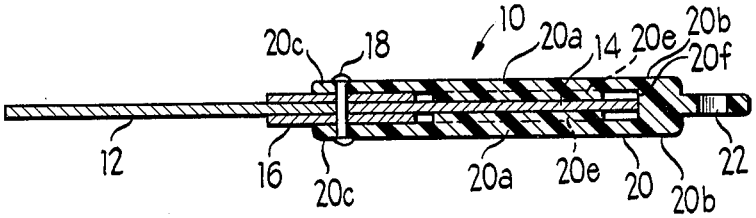
Fig 6

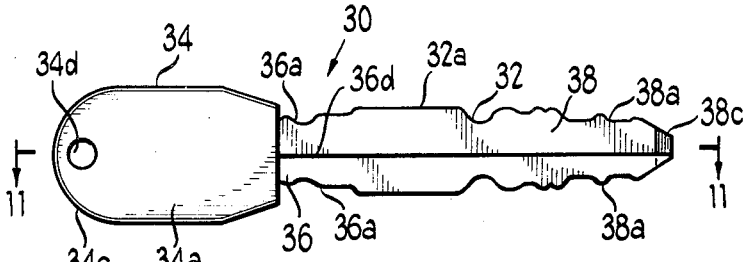
Fig 7
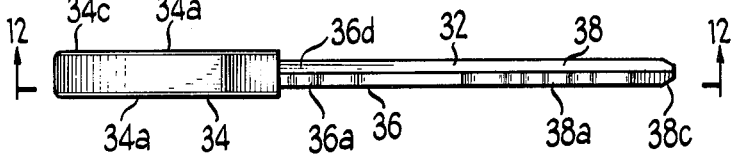
Fig 8
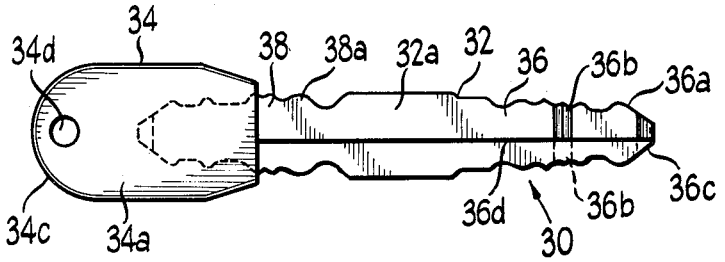
Fig 9
Fig 10
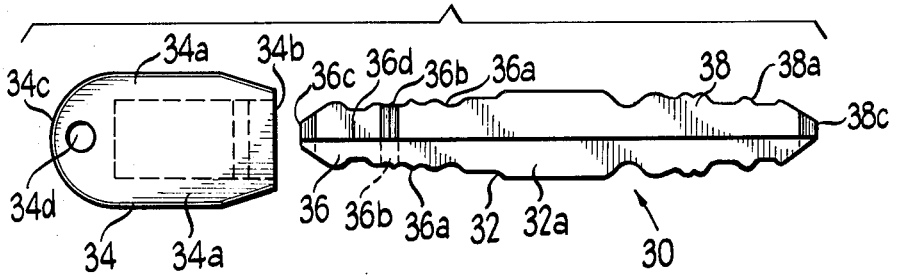
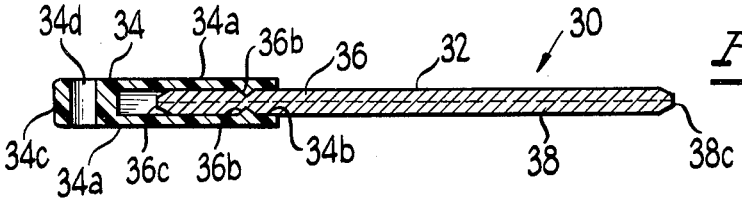
Fig 11
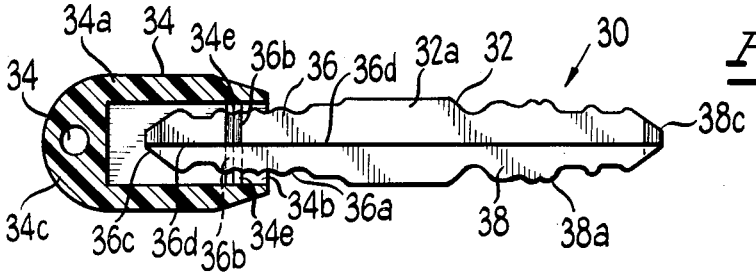
Fig 12

KEY CONSTRUCTION

The present invention relates to a key construction, and, in particular, to a unitary key construction having key bits for use in different lock tumblers.

While the lock tumblers used on the doors of dwellings, and on the doors, trunk lid, and ignition switch of motor vehicles are different, the keys used to operate these tumblers are essentially indistinguishable to the average person except, as in the case of keys for motor vehicles, for the shape of the head of the key. Even then, operators of motor vehicles often mistakenly attempt to insert the ignition switch key in the door or trunk lid lock, or the door or trunk lid key in the ignition switch.

In accordance with the present invention, a key construction has been evolved which enables key bits for different lock tumblers to be easily, readily and unerringly distinguished so that each key bit will always be inserted into the lock tumbler for which it is intended. The key construction, while comprised of more than one key bit, is compact and can be conveniently carried on a key chain or in a conventional key case.

The key construction of this invention, in one of its forms, comprises a pair of key shanks each of which is provided with a key bit for engagement with a different lock tumbler. The key shanks advantageously are joined at one end in aligned, oppositely extending relation by a sleeve member. The sleeve member desirably is pivotally attached to an end of a key bit receiving member or holder adapted to normally completely encase one of the key bits but not the other. The key bit holder may be provided with an opening or hole at the outer end thereof to enable it to be attached to a key chain, a key ring, or a pin of the type conventionally used in key cases.

In another of its forms, the key construction comprises a unitary, elongated body portion having a key bit formed at each of its ends, each key bit being adapted to engage a different lock tumbler. One of the key bits, inwardly of its outer end, advantageously is provided with a depression or groove on each side for engaging a pair of ridges or ribs formed on the inner walls of a hollow, key-head like, key bit receiving member or holder. The key bit receiving member or holder desirably has an opening or hole formed therein for attaching it to a key chain, a key ring or a key pin.

The foregoing, and other features and advantages of the key construction of this invention will become clear to those skilled in the art upon reference to the accompanying specification, claims, and drawings wherein:

FIG. 1 is a side view in elevation of an embodiment of the key construction of the present invention;

FIG. 2 is a plan view in elevation of said embodiment of the key construction;

FIG. 3 is a side view in elevation showing the key bits in a rotated position;

FIG. 4 is a fragmentary exploded side view of said embodiment;

FIG. 5 is a sectional view taken substantially along line 5—5 of FIG. 2;

FIG. 6 is a sectional view taken substantially along line 6—6 of FIG. 1;

FIG. 7 is a side view in elevation of another embodiment of the key construction;

FIG. 8 is a plan view in elevation of the embodiment shown in FIG. 7;

FIG. 9 is a side view in elevation of the embodiment shown in FIG. 7 with the key bits in a reversed position;

FIG. 10 is an exploded side view of the embodiment shown in FIG. 7;

FIG. 11 is a sectional view taken substantially along line 5—5 of FIG. 7; and FIG. 12 is a sectional view taken substantially along line 6—6 of FIG. 8.

Referring, now, in greater detail to FIGS. 1 through 6 of the drawings, the embodiment of the key construction illustrated, and designated generally by reference numeral 10, comprises a pair of key shanks 12 and 14 having a key bit **12*a* and 14*a*, respectively, formed at the distal or outer end thereof. Each key bit 12*a* and 14*a* is adapted to operate a different lock tumbler. Thus, for example, the key bits can be designed to operate a deadbolt lock and a door knob type lock on a door of a house or apartment, or similar dwelling. In the embodiment of the key construction 10 shown, the bit 12*a* desirably is designed to operate the locks on the doors and the trunk lid of a motor vehicle of the type manufactured by General Motors Corporation, while the bit 14*a*** is designed to operate the ignition switch of the vehicle.

As illustrated, the inner ends **12*b* and 14*b*, respectively, of the key shanks 12 and 14 are joined by an open-ended sleeve 16, in substantially aligned, oppositely extending relation to one another with their working edges or sides 12*c* and 14*c*, respectively, facing in opposite directions. The ends 12*b* and 14*b* of the shanks 12 and 14 may be secured in the sleeve in any of various ways including crimping, brazing, spot welding, or the like. In the embodiment shown, the sleeve 16 desirably is crimped on the ends 12*b* and 14*b* of the shanks 12 and 14. To this end, depressions or grooves 12*d*—12*d* and 14*d*—14*d*, respectively, are provided along the longitudinal edges of the ends 12*b* and 14*b*, inwardly of the innermost edge 12*e* and 14*e*, respectively, of the shanks 12 and 14. The material, preferably metal, of which the sleeve 16 is fabricated, when crimped into engagement with the depressions or grooves 12*d*—12*d* and 14*d*—14*d*, will firmly and rigidly anchor the ends 12*b* and 14*b* of the shanks 12 and 14 in the sleeve 16. The sleeve 16 advantageously is provided with a centrally located, transverse bore or opening 16*a* for receiving a rivet or pin 18. To accommodate the pin 18, the abutting innermost edges 12*e* and 14*e* of the shanks 12 and 14 desirably are provided with rounded recesses 12*f* and 14*f***, respectively.

The unitary structure formed by the key shanks 12 and 14 and the sleeve 16 is pivotally attached through the pin 18 to an end of a key bit holder 20. The holder 20 may be fabricated of plastic, metal, or the like, and, as illustrated, comprises spaced side walls **20*a*—20*a* joined at their outer ends 20*b*—20*b* and open at their inner ends 20*c*—20*c*. The opening provided by the inner ends 20*c*—20*c* of the side walls of the holder 20 is adapted to receive the sleeve 16. Holes 20*d*—20*d* are formed in the ends 20*c*—20*c* for receiving the pin 18. Intermediate the inner and outer ends of the side walls of the holder 20, a pair of opposed inwardly extending ridges or ribs 20*e*—20*e* are formed on the opposed inner surfaces of the side walls 20*a*—20*a*. The ribs 20*e*—20*e* resiliently engage the sides of the key bit 14 inwardly of the working edge 12*c* thereof and releasably retain it in its normal position within the holder 20. An inwardly extending key bit engaging bumper or stop 20*f* is formed between the inner surfaces of the side walls 20*a*—20*a*, at the joined outer ends 20*b*—20*b* of the side walls. The bumper or stop 20***f* prevents the key bits 12 and 14 from being rotated through a complete 360° angle about the pivot pin 18 for reasons that will be made clear as the description proceeds. A hole 22 desirably is provided for outer end of the holder 20 for attaching the holder to a key chain, a key ring, or a key case pin.

As stated above, the key construction of the present invention readily and unerringly enables one to distinguish which key bit goes into which lock tumbler. Thus, in the embodiment illustrated in FIGS. 1–6, the key bit 14 for operating the ignition switch of a motor vehicle is normally resiliently retained in the holder 20 by the ribs 20*e*—20*e*, while the key bit 12, adapted to operate the door and trunk lid locks of the vehicle, is normally maintained in an extended ready-for-use position. When it is desired to use the key bit 14, it is pivoted out of the holder 20 in the direction indicated by the arrows in FIG. 3 of the drawings. Rotation or pivoting of the bit 14 in the opposite direction is prevented by the stop 20*f* between the side walls 20*a*—20*a* of the holder 20. When the bit 14 has been pivoted to its operative position, the bit 12 will be in an inoperative position in the holder 20 with its outer end in engagement with the side of the stop 20*f* opposite to that which prevents complete rotation of the bit 14 between the side walls 20*a*—20*a* of the holder 20. The ribs 20*e*—20*e* do not engage the sides of the bit 12 as is the case with the bit 14, and thus there is no provision made for resiliently maintaining the bit 12 in the holder 20 while the bit 14 is in use. Frictional forces, however, serve to prevent the bit 12 from being disengaged from the holder 20 while the bit 14 is in use. Rotation of the bit 14 from the holder 20 positions the bit 14 so that it can be inserted directly into the ignition switch without the need for rotating the entire key holder through an angle of 180° as would be required if the working surfaces 12*c* and 14*c* of the key bits 12 and 14 were facing in the same direction.

Referring, now, to FIGS. 7 through 12 of the drawings, the embodiment of the key construction illustrated, and designated generally by reference numeral 30, comprises an elongated, unitary key bit member 32 and a separable key head-like holder 34 for the member 32. The key head-like holder 34 comprises spaced side walls 34*a*—34*a* which form an opening 34*b* at one end of the folder 34 for admitting an end of the key bit member 32. The other end 34*c* of the holder is closed and desirably is provided with a hole 34*d* therethrough to enable the construction 30 to be carried on a key chain, a key ring, or the like. The inner surface of each of the side walls 34*a*—34*a*, inwardly of the opening 34*b*, are provided with inwardly extending ridges or ribs 34*e*—*34e*, the purpose of which will become clear as the description proceeds. The holder 34 may be fabricated of a resilient material such as plastic, metal, or the like.

The key bit member 32 has a central, key shanklike portion 32*a* joined to aligned, oppositely extending key bits 36 and 38. The key key bits 36 and 38, like the key bits 12*a* and 14*a* of the previously described key construction 10, each operate a different lock tumbler. While the key construction 30 may be used for the locks on the doors of dwellings as in the case of the construction 10, the construction 30 is especially useful for operating the trunk lid lock, and the door locks and ignition switch of Ford Motor Company automobiles. Thus, as shown, the key bits 36 and 38 are each provided with duplicate, longitudinally extending working edges 36*a*—36*a* and 38*a*—38*a*, respectively, so that either edge of the appropriate key bit can be used to operate the trunk lid lock, or the door locks and the ignition switch. For purposes of illustration, the key bit 36 is designed to operate the lock on the trunk lid of a Ford vehicle, while the key bit 38 is designed for use in the door locks and the ignition switch of the vehicle.

As best shown in FIGS. 9–12, each side of the key bit 36 is provided with a short, transverse depression or groove 36*d* inwardly of the beveled end 36*c* of the key bit. The grooves 36*b* desirably extend from the working edge 36*a* on one side of the key bit 36 to the base 36*d* of the working edge 36*a* on the other side of the bit. The grooves 36*b*—36*b* are adapted to resiliently, releasably engage the inwardly extending ribs 34*e*—34*e* on the inner surface of the side walls 34*a*—34a of the holder 34.

The key bit 36 which, as stated, operates the lock tumbler on the trunk lid, is normally carried in the holder 34, the ribs 34*e*—34*e* and the grooves 36*b*—36*b* being interengaged as shown in FIG. 11. The bit 38, which operates the locks on the doors and the ignition switch, is thus in a position for use at all times except when it is desired to unlock the trunk lid. To unlock the trunk lid, it is merely necessary to pull the member 32 away from the holder 34 to release the bit 36. The beveled end 38*c* of the bit 38 can then be inserted into the holder 34, and the bit 36 used to unlock the trunk lid. The bit 36 thereafter is snapped into position in the holder 34. The grooves 36*b*—36*b* on the bit 36 enable a user to readily and easily distinguish the trunk lid key bit from the key bit for the locks on the doors and the ignition switch.

While certain prefered embodiments of the key construction of the present invention have been disclosed, it is apparent that further modifications may be made in the key construction by those skilled in the art without departing from the spirit and scope of the invention.

What is claimed is:

1. A key construction comprising a pair of key shanks, each of which has a key bit adapted to engage different lock tumblers, key shank retaining means for rigidly supporting the key bits in aligned opposed relation to one another, and key bit receiving means pivotally mounted on the key shank retaining means whereby the key bits can be selectively and alternatively moved from an operative to an inoperative position, said key bit receiving means providing a finger gripping surface for facilitating the engagement and the turning of said selected key bit in its respective different lock tumbler.

2. A key construction according to claim 1 wherein the key shank retaining means comprises an open-ended sleeve for receiving and rigidly supporting an end of the key shanks whereby the key bits are held in aligned oppositely extending relation to one another.

3. A key construction according to claim 2 wherein the open-ended sleeve has pivot means attached thereto, and the key bit receiving means is secured to the sleeve through said pivot means.

4. A key construction according to claim 1 wherein the key bit receiving means is open along at least one of it longitudinal margins to admit a key bit, and key bit engaging means is provided within the key bit receiving means for releasably maintaining the key bit in the receiving means.

5. A key construction according to claim 1 wherein the key bit receiving means comprises spaced, resilient side walls having an opening at one end thereof for receiving the key shank retaining means, said side walls being provided with elongated, inwardly extending key bit engaging ribs for normally releasably maintaining at least one of the key bits in the key bit receiving means.

* * * * *